US005918559A

United States Patent [19]

Sakino

[11] Patent Number: 5,918,559

[45] Date of Patent: Jul. 6, 1999

[54] APPARATUS INCLUDING MAGNET FOR PROTECTION FROM A BROKEN NEEDLE OF A SEWING MACHINE

[76] Inventor: Tsutomu Sakino, 401-1 Oyama-cho, Izumo City Shimane-pref., 693, Japan

[21] Appl. No.: 08/993,193

[22] Filed: Dec. 18, 1997

Related U.S. Application Data

[62] Division of application No. 08/720,251, Sep. 26, 1996, Pat. No. 5,791,273.

[30] Foreign Application Priority Data

Sep. 29, 1995 [JP] Japan ..... 7-252234
Apr. 30, 1996 [JP] Japan ..... 8-108857

[51] Int. Cl.[6] ..... D05B 83/00

[52] U.S. Cl. ..... 112/261; 112/235

[58] Field of Search ..... 112/261, 235, 112/443

[56] References Cited

U.S. PATENT DOCUMENTS

| | | | |
|---|---|---|---|
| 1,234,556 | 7/1917 | Miller | 112/261 |
| 1,288,359 | 12/1918 | Wright | 112/261 |
| 1,408,821 | 3/1922 | Merrick | 112/261 |
| 1,419,718 | 6/1922 | Chertok | 112/261 |
| 1,455,800 | 5/1923 | Miller | 112/261 |
| 1,617,223 | 2/1927 | Shaunessey | 112/261 |
| 1,939,620 | 12/1933 | Ciravolo | 112/261 |
| 1,959,138 | 5/1934 | Nimmer | 112/261 X |
| 2,556,406 | 6/1951 | Wapner | 112/261 |
| 2,570,705 | 10/1951 | Pelletier | 112/261 |
| 3,019,751 | 2/1962 | Ficera | 112/261 |
| 4,150,634 | 4/1979 | Brown et al. | 112/261 |
| 4,248,167 | 2/1981 | Reinert | 112/443 |
| 4,289,084 | 9/1981 | Takenoya et al. | 112/235 |
| 5,791,273 | 8/1998 | Sakino | 112/261 |

FOREIGN PATENT DOCUMENTS

| | | | |
|---|---|---|---|
| US005791273A | 8/1998 | Japan | 112/261 |

*Primary Examiner*—Ismael Izaguirre
*Attorney, Agent, or Firm*—Staas & Halsey

[57] ABSTRACT

An apparatus for protection from a broken needle of a sewing machine has a needle cover within which a needle of the sewing machine moves vertically. A capturing portion is formed at the lower portion of the needle cover for capturing broken pieces of a needle. The needle cover is removably attached to a presser bar of the sewing machine using a support member. Preferably, a magnet is used to enhance the performance of the protecting apparatus.

7 Claims, 13 Drawing Sheets

APPARATUS INCLUDING MAGNET FOR PROTECTION FROM A BROKEN NEEDLE OF A SEWING MACHINE

This application is a divisional of Ser. No. 08/720,251, filed Sep. 26, 1996 now U.S. Pat. No. 5,791,273.

BACKGROUND OF THE INVENTION

1. Field of the Invention

The present invention relates to an apparatus for protection from a broken needle of a sewing machine which prevents a needle from penetrating by accident a fingertip of a worker during sewing work at a sewing shop or at home and which prevents occurrence of an accident caused by scattering broken pieces of a needle when the needle breaks.

2. Description of the Related Art

Conventionally, when a needle breaks during sewing work, it is difficult for a worker to visually trace scattered broken pieces of the needle so as to find how far the broken pieces of the needle have scattered and locations to which the broken pieces of the needle have reached. Thus, it is impossible for the worker to collect all scattered broken pieces of the needle. This is one of the reasons why there still arises an accident that a broken piece of a needle remains in a sewn product.

In order to protect a worker, some of recent sewing machines have a protection cover. Such sewing machines include an over-lock sewing machine and an electronic-lock sewing machine. However, a protection cover located between a work and a worker deteriorates work performance in a sophisticated sewing process in which the worker needs to handle the work at a position close to the needle.

In a sewing machine which is used in a sophisticated sewing process, for example, in a single-needle lock stitch sewing machine, a worker protection cover is not provided. A protection cover for protecting a worker from a potential danger is known as described below, but a needle cover for collecting broken pieces of a needle is not known.

A protection device is disclosed in, for example, Japanese Utility Model Application Laid-Open No. 1-69480, in which the description of the protection device reads as "comprising a substantially L-shaped transparent synthetic resin cover 1, a cutter holding frame 4 which is pivoted to the cover 1 at one end to thereby form a hinge portion, and a thread cutter 5 which is removably attached to the holding frame 4, wherein the cover 1 protects a worker from scattering broken pieces of a needle 2 which is running at a high speed when the needle 2 breaks during sewing work, and prevents the needle 2 from penetrating a fingertip of a worker and wherein upon completion of sewing, thread is cut by a cutter 5 of the holding frame 4 which is pivoted to the cover 1."

Also, a safety device is disclosed in, for example, Japanese Utility Model Application Laid-Open No. 58-29071, in which the description of the safety device reads as "a safety device for covering the front side of a needle which makes seams, comprising a mounting base 1 which has a guide groove 2 for removably attaching the mounting base 1 by one-touch operation to a presser bar 12 through an elastic force, a guide plate spindle 6 which is fixedly attached to the mounting base 1 such that it extends downward, and a guard plate 10 whose one end is pivotably fit to the guard plate spindle 6 and to which a force is applied by a spring 7 in a single direction, wherein the guard plate 10 serves as a needle cover which can swing about the guard plate spindle 6."

The protection device disclosed in the above-described Japanese Utility Model Application No. 1-69480 uses a transparent acrylic cover for protecting a worker from broken pieces of a needle in case the needle breaks. However, since the cover does not cover a needle located below a needle bar, a broken tip and/or broken pieces of the needle scatter around when the needle breaks.

The safety device disclosed in the above-described Japanese Utility Model Application No. 58-29071 also has the same problem that a broken tip and/or broken pieces of a needle scatter around.

In the sewing industry, management of needles is one of the important tasks. In a sewing shop, a broken-needle report and a needle stock daily report are used to manage needles. When a needle breaks, a work area is searched for broken pieces of the needle using a magnet. However, it takes a lot of time and labor to collect small broken pieces which may be caught in a clearance of a sewing machine, a clearance formed in a floor, or the like.

SUMMARY OF THE INVENTION

In view of the above-described problems in relation to safety at the time when a needle of a sewing machine breaks, it is an object of the present invention to provide an apparatus for protection from a broken needle of a sewing machine. The protecting apparatus protects a fingertip of a worker during sewing work, prevents occurrence of an accident caused by scattering broken pieces of a needle, and allows a worker to collect substantially all broken pieces of a needle when the needle breaks.

To achieve the above object, the present invention provides an apparatus for protection from a broken needle of a sewing machine which comprises a needle cover within which a needle of the sewing machine moves vertically. A capturing portion is formed at the lower portion of the needle cover for capturing broken pieces of a needle. The needle cover is removably attached to a presser bar of the sewing machine using a support member.

The present invention also provides an apparatus for protection from a broken needle of a sewing machine which comprises a needle cover made of a transparent synthetic resin within which a needle of the sewing machine moves vertically. The needle cover is composed of a cylindrical portion and an inverse truncated cone portion which is formed at the lower end of the cylindrical portion. A non-drying adhesive layer is formed on the inner wall surface of the cylindrical portion as well as the inverse truncated cone portion. The needle cover is removably attached to a presser bar of the sewing machine using a support member which allows the needle cover to slide therein vertically as well as rotatively.

The present invention also provides an apparatus for protection from a broken needle of a sewing machine, which comprises a needle cover made of a transparent synthetic resin within which a needle of the sewing machine moves vertically. A magnet portion having an inverse truncated cone shape is provided at the lower end of the cylindrical portion of the needle cover. The needle cover is removably attached to a presser bar of the sewing machine using a support member.

Preferably, the cylindrical portion is formed such that it can be opened along its longitudinal direction.

Preferably, the magnet portion is provided on the outer wall surface of the bottom end section of the inverse truncated cone portion.

The present invention also provides an apparatus for protection from a broken needle of a sewing machine which comprises a needle cover made of a transparent synthetic resin within which a needle of the sewing machine moves vertically. The needle cover is formed such that it surrounds a needle bar and a presser bar of the sewing machine, and such that the bottom end of the needle cover is located in the vicinity of a presser member. The needle cover is removably attached to the presser bar of the sewing machine.

The present invention also provides an apparatus for protection from a broken needle of a sewing machine which comprises a needle cover made of a transparent synthetic resin within which a needle of the sewing machine moves vertically. The needle cover is formed such that it surrounds a needle bar and a presser bar of the sewing machine, and such that the bottom end of the needle cover is located in the vicinity of a magnetized presser member. The needle cover is removably attached to the presser bar of the sewing machine.

Preferably, a needle capturing portion made of at least one magnet is provided at the upper portion of the presser member.

The present invention also provides an apparatus for protection from a broken needle of a sewing machine which comprises a needle cover made of a transparent synthetic resin within which a needle of the sewing machine moves vertically. The needle cover is formed such that it surrounds a needle bar and a presser bar, and such that the bottom end of the needle cover is located in the vicinity of a presser member. A magnet member is provided adjacent to a presser bar to which a support member of the needle cover is attached and the presser bar and the presser member are made of a metallic member so as to be magnetized by the magnet member.

The apparatus for protection from a broken needle of a sewing machine according to the present invention can protect a fingertip of a worker during sewing work, prevent an accident caused by scattering broken pieces of a needle, and allow broken pieces of a needle to be collected substantially completely.

Since a needle is covered with the needle cover, it is possible to prevent the needle from penetrating by accident a fingertip of a worker as well as to prevent broken pieces of the needle from scattering around. Thus, it is possible to prevent a broken piece of the needle from entering by accident an eye or mouth of the worker.

Most broken pieces of a needle adhere to the non-drying adhesive layer formed on the inner wall of the needle cover, or are attracted onto the magnet portion. Even when some broken pieces fail to adhere to the layer or to be attracted onto the magnet portion, they drop under the needle cover. Thus, broken pieces of the needle can be readily and substantially completely collected. This reduces loss time which is caused by collecting broken pieces of a needle.

Since substantially an entire needle is covered with a needle cover, there exists no clearance which allows a fingertip of a worker to enter a passage of a vertically moving needle during sewing work. Thus, the worker is protected from an accident that the needle penetrates his/her fingertip, while conventional sewing performance is maintained. Further, even a sophisticated sewing process is not deteriorated.

Even when a needle breaks and scatters within a needle cover, broken pieces of a needle hit a plastic magnet member of the needle cover and are attracted to the plastic magnet member. Thus, the broken pieces are prevented from scattering outside the needle cover.

A non-cylindrical needle cover can be readily and reliably attached to the presser bar of the sewing machine.

BRIEF DESCRIPTION OF THE DRAWINGS

The structure and features of an apparatus for protection from a broken needle of a sewing machine (hereinafter referred to merely as the "protecting apparatus") according to the present invention will be readily appreciated as the same becomes better understood by referring to the drawings, in which.

DESCRIPTION OF THE PREFERRED EMBODIMENTS

Figure 1:
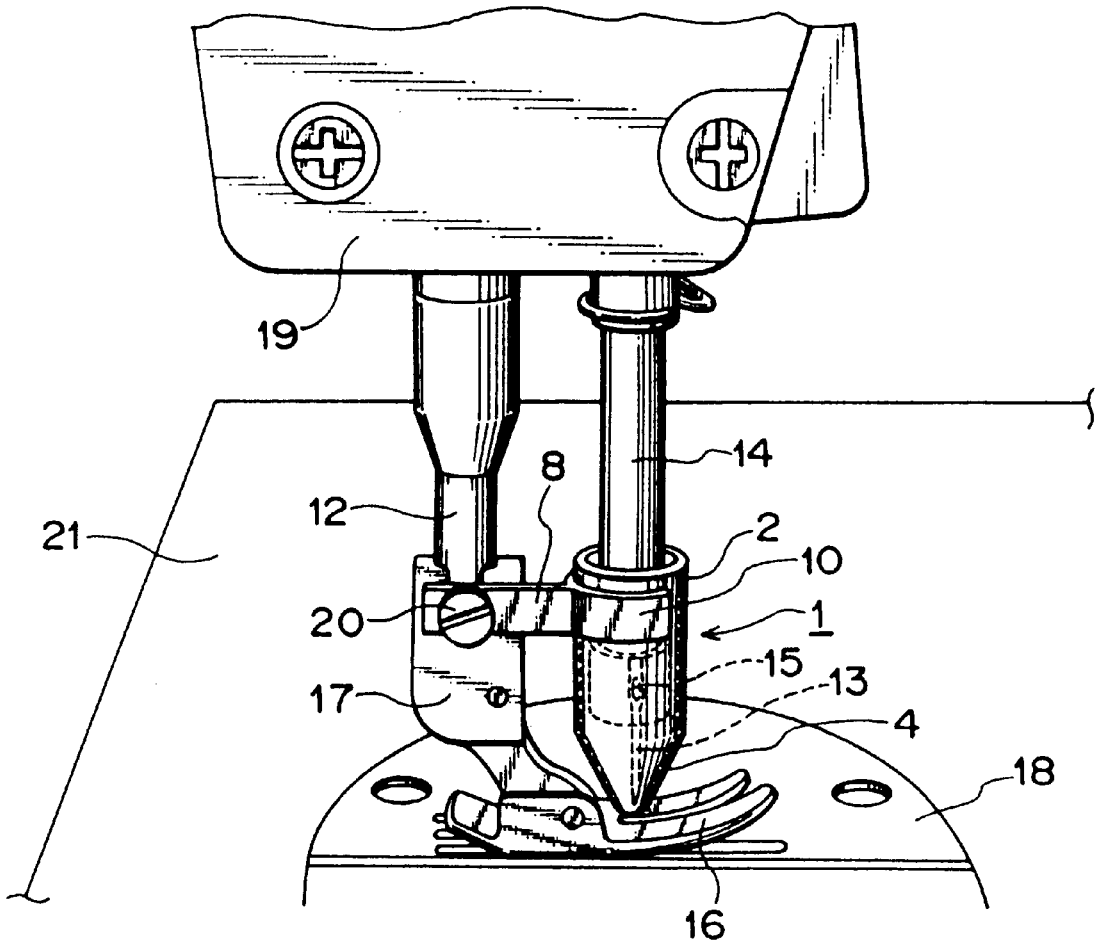
FIG. 1 is a perspective view of a first embodiment of the protecting apparatus according to the present invention.
Figure 2:
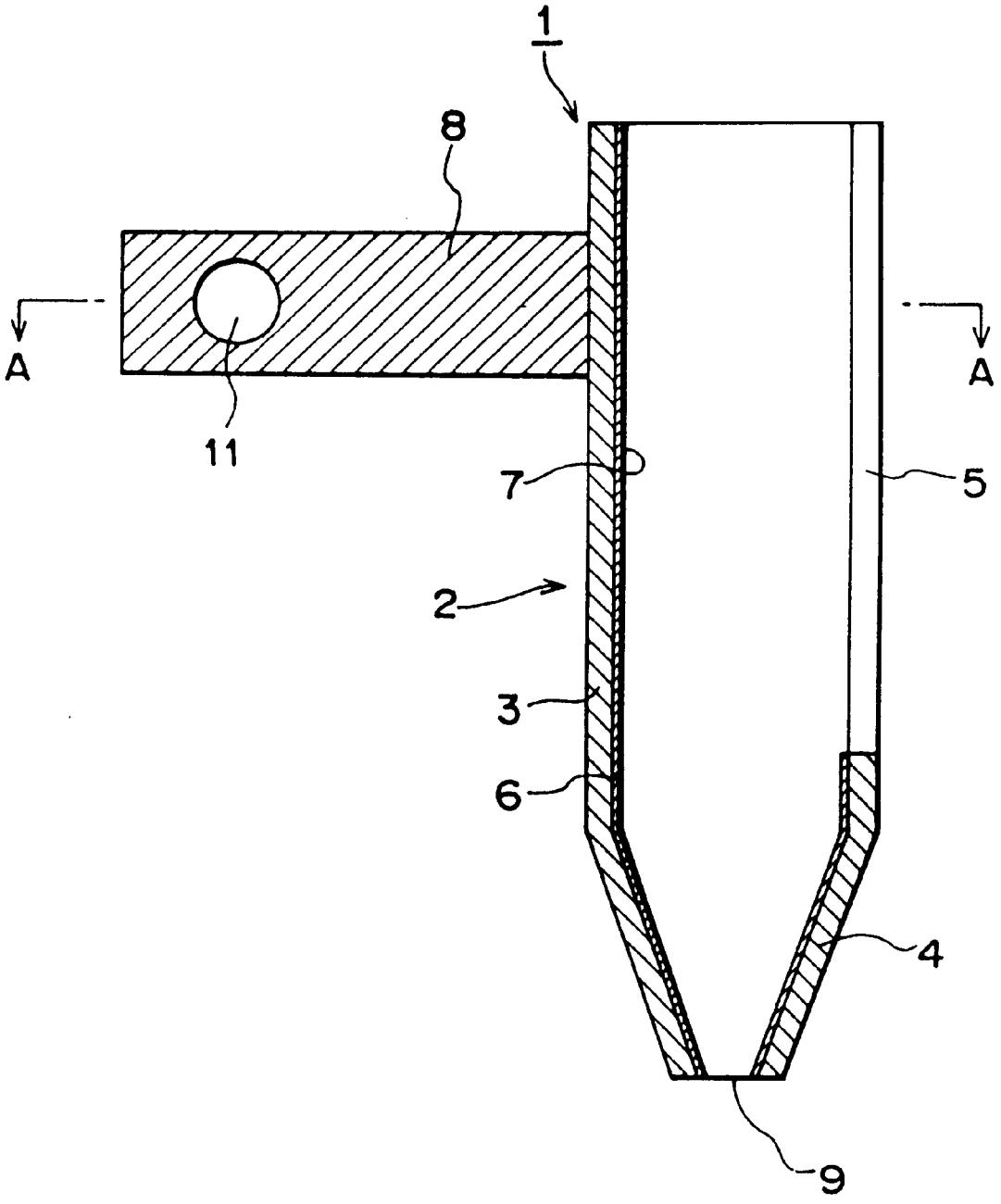
FIG. 2 is a longitudinal section of the first embodiment of the protecting apparatus.
Figure 3:
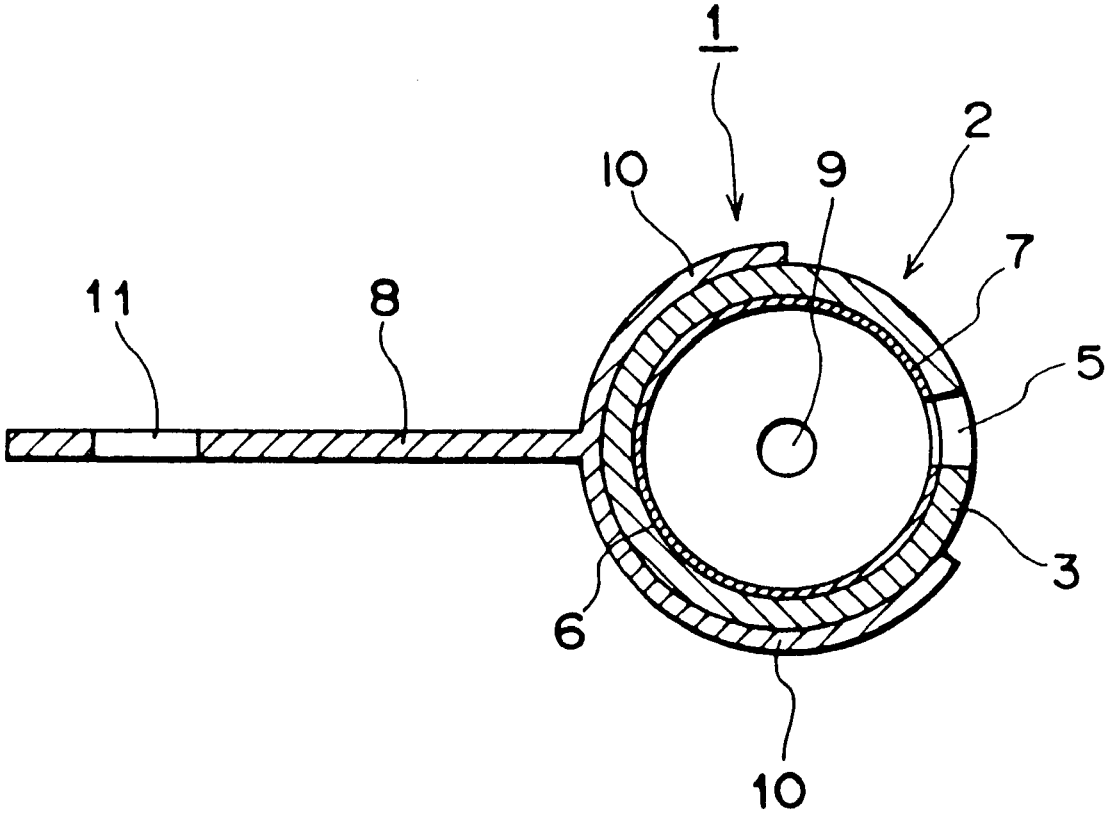
FIG. 3 is a cross-section taken along line 3—3 of FIG. 2.
Figure 10:
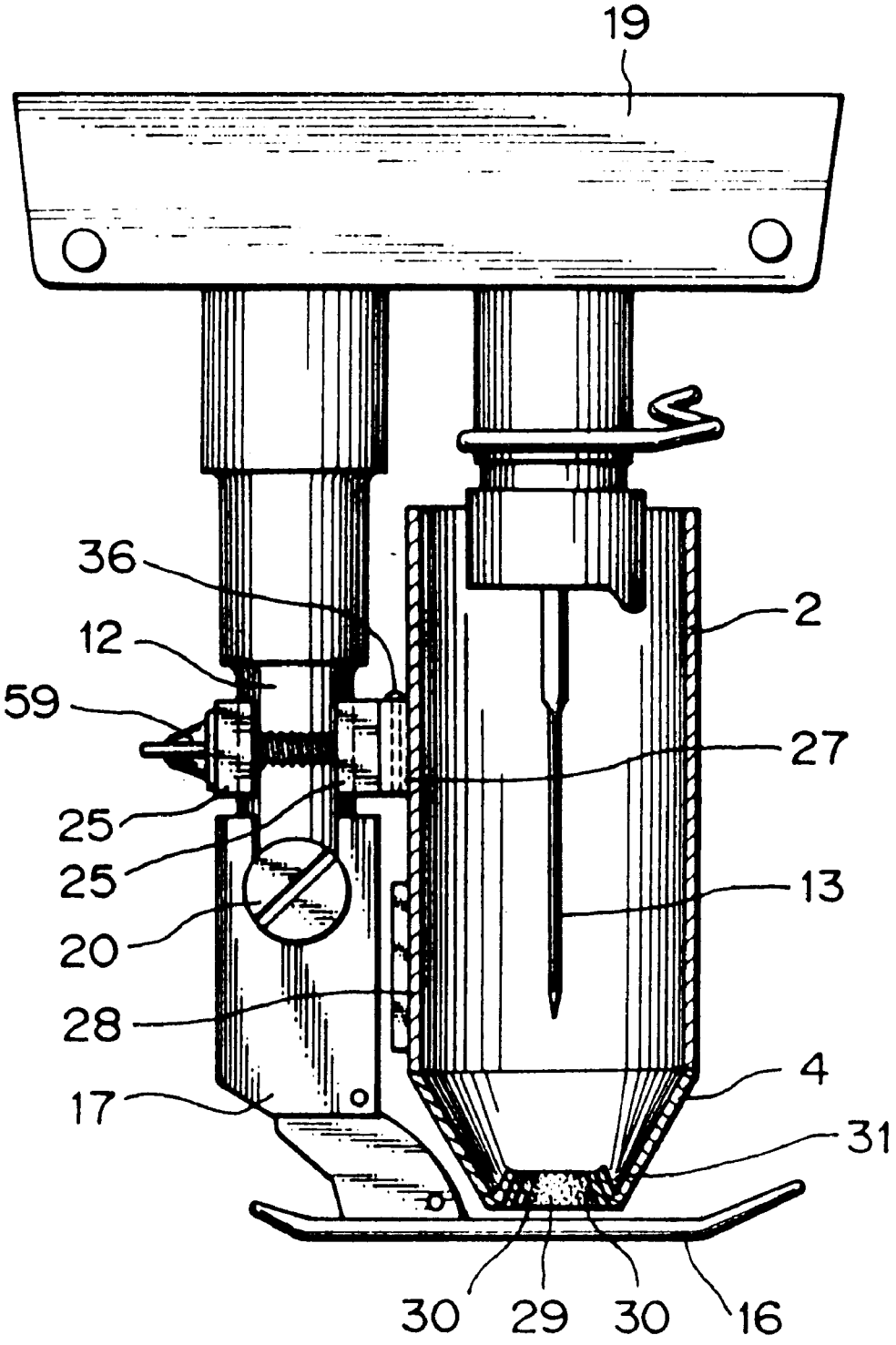
FIG. 10 is a partially cross-sectioned side view of a third embodiment of the protecting apparatus.
Figure 11:
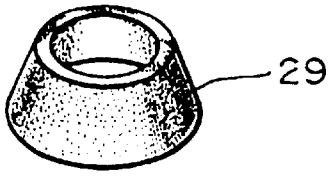
FIG. 11 is a perspective view of a plastic magnet member having a truncated cone shape which is used in the third embodiment of the protecting apparatus.
Figure 12:
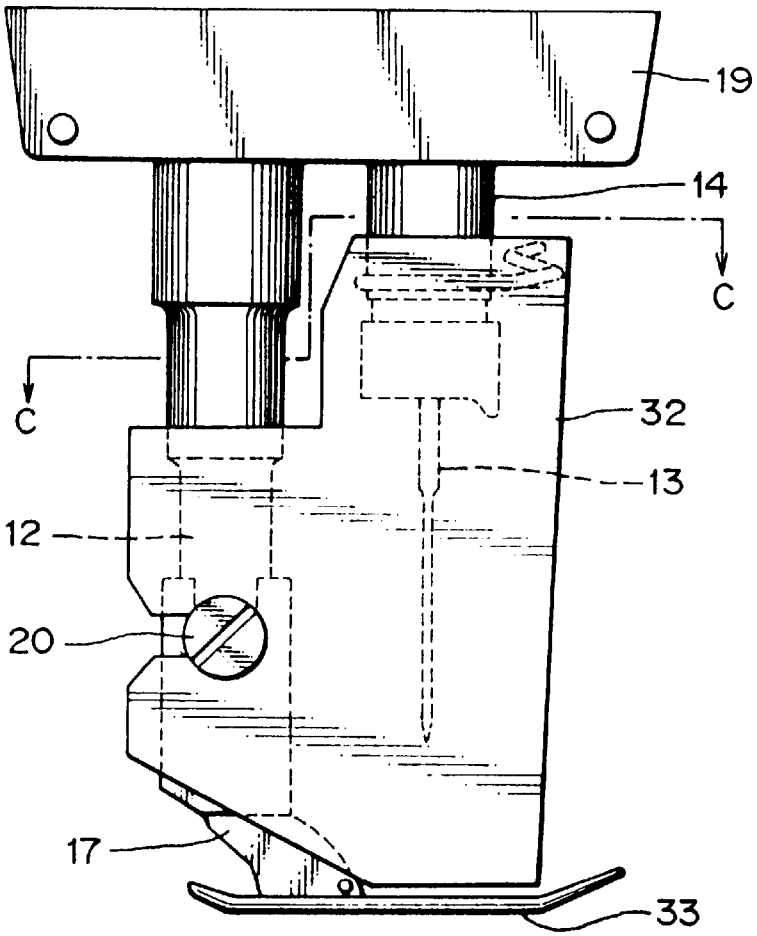
FIG. 12 is a side view of a fourth embodiment of the protecting apparatus.
Figure 13:
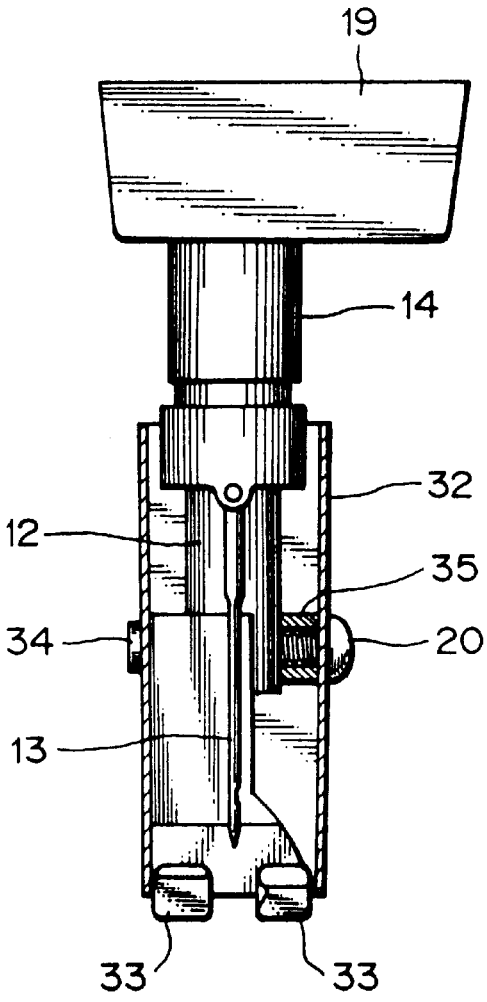
FIG. 13 is a partially cross-sectioned front view showing a main portion of the fourth embodiment of the protecting apparatus.
Figure 14:
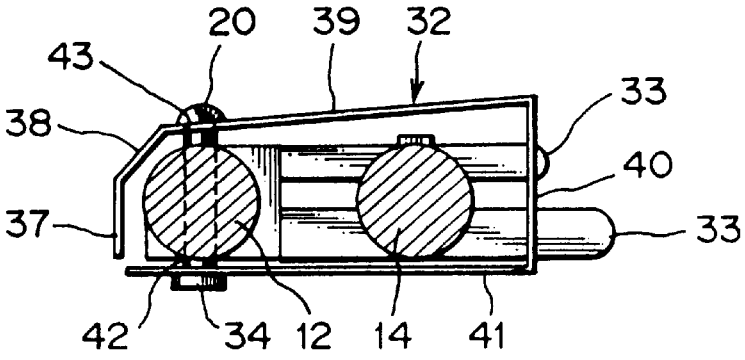
FIG. 14 is a cross-section taken along line 14—14 of FIG. 12.
Figure 15:
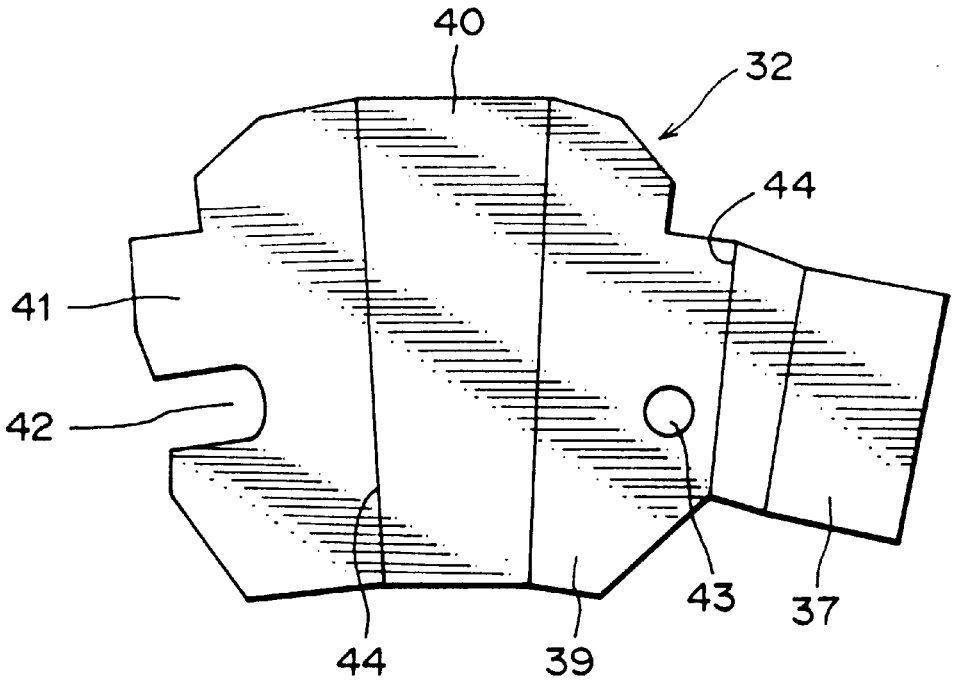
FIG. 15 is a development of a non-cylindrical needle cover used in the fourth embodiment of the protecting apparatus.
Figure 16:
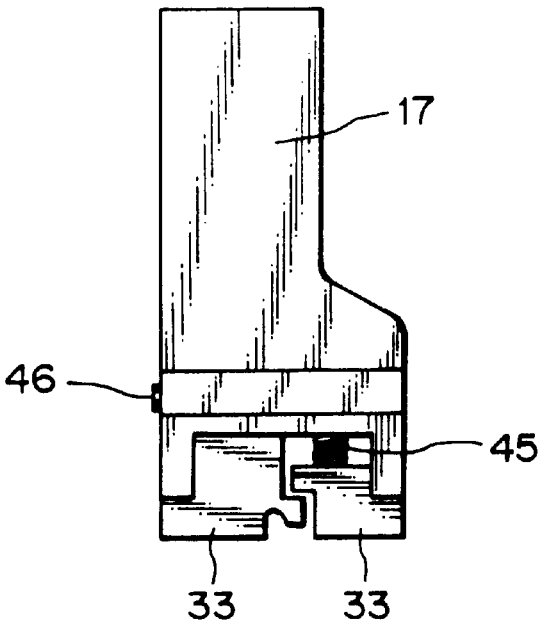
FIG. 16 is a front view showing part of a fifth embodiment of the protecting apparatus.
Figure 17:
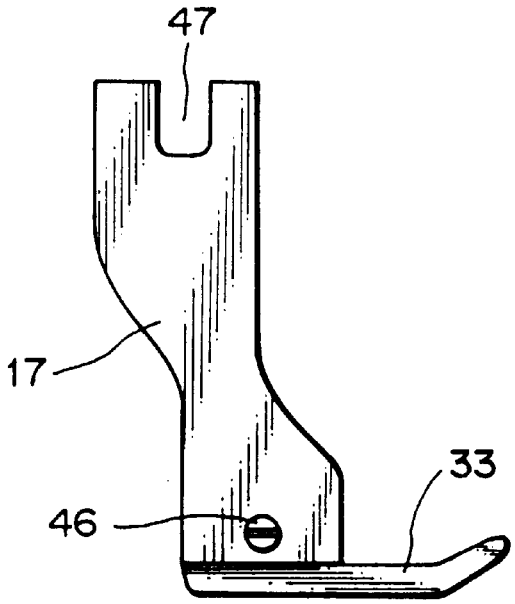
FIG. 17 is a side view of the fifth embodiment of the protecting apparatus.
Figure 18:
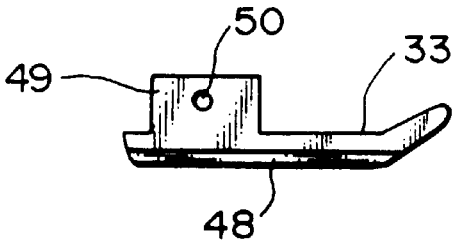
FIG. 18 is a side view of a presser member made of plastic magnet.
Figure 19:
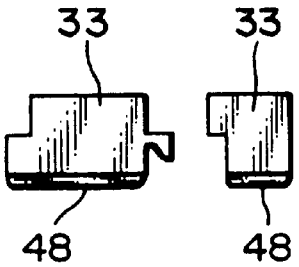
FIG. 19 is a front view of the presser member of FIG. 18.
Figure 20:
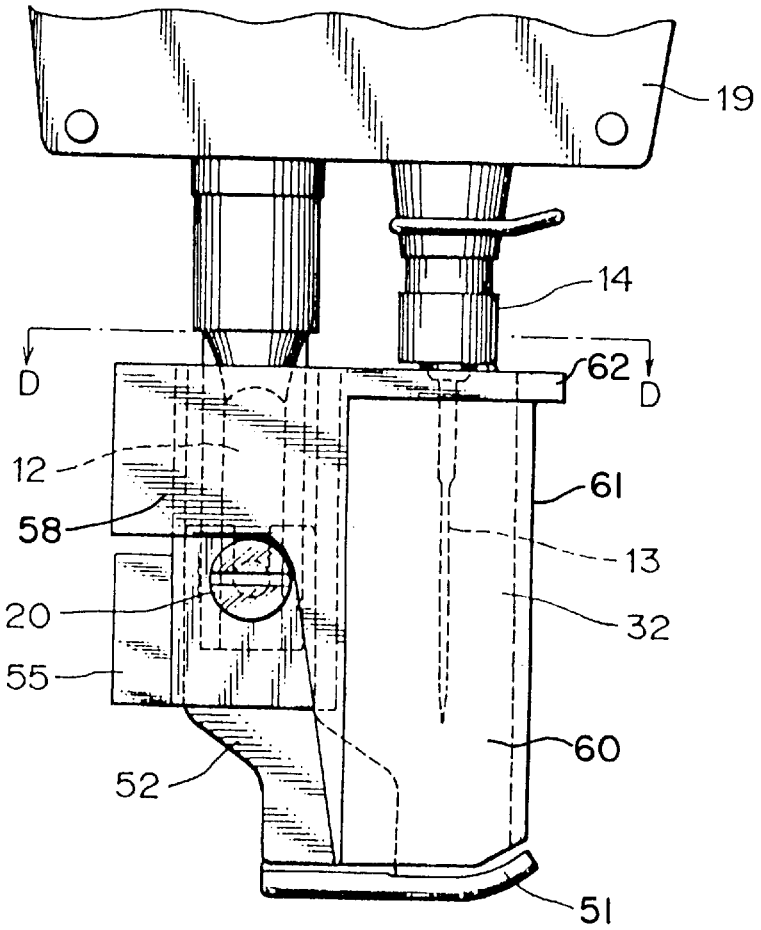
FIG. 20 is a side view showing a main portion of a six embodiment of the protecting apparatus.
Figure 21:
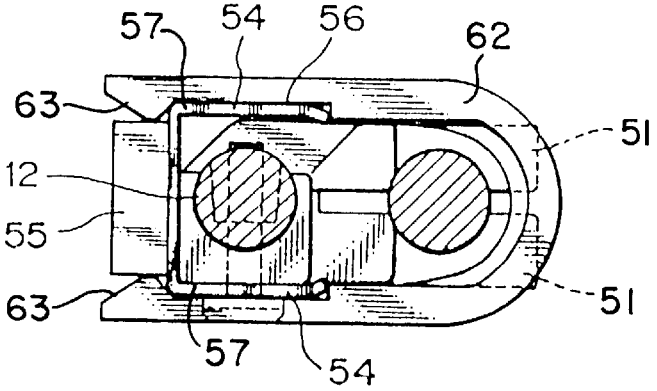
FIG. 21 is a cross-section taken along line 21—21 of FIG. 20.

Embodiments of the present invention will now be described with reference to the drawings. FIGS. 1 to 3 show a first embodiment of the protection apparatus according to the present invention; FIGS. 4 to 9 show a second embodiment of the protecting apparatus; FIGS. 10 and 11 show a third embodiment of the protecting apparatus; FIGS. 12 to 15 show a fourth embodiment of the protecting apparatus; FIGS. 16 to 19 show a fifth embodiment of the protecting apparatus; and FIGS. 20 and 21 show a sixth embodiment of the protecting apparatus.

The first embodiment of the protecting apparatus according to the present invention will be described with reference to FIGS. 1 to 3. A protecting apparatus 1 is attached to a presser bar 12 of a sewing machine via a support member 8 such that a needle bar 14 can move vertically within a needle cover 2 made of a transparent synthetic resin. A needle 13 moves vertically within the needle cover 2. A non-drying adhesive layer 7 is formed on an inner wall surface 6 of a cylindrical portion 3 as well as on an inverse truncated cone portion 4 formed at the lower section of the cylindrical portion 3. The support member 8 is removably attached to the presser bar 12 using a mounting screw 20. Forked elastic holding portions 10 and 10 of the support member 8 hold the outer circumferential surface of the needle cover 2 such that the needle cover 2 is slidable vertically as well as rotatively.

An adhesive used as material for the adhesive layer 7 is prepared, for example, by a method in which diphenylmethane diisocyanate is added to an acrylic resin (polyacrylate), which is a main component, and the resulting mixture is mixed in a solvent liquid of acetone.

In order to prevent the mounting screw (not shown), which secures the needle 13 to the needle bar 14, from hindering vertical movement of the needle 13 within the needle cover 2, a cut portion 5 is formed in the cylindrical portion 3 of the needle cover 2 such that it extends from the top end of the cylindrical portion 3 to a position located above the inverse truncated cone portion 4. The cut portion 5 allows the mounting screw to move therethrough. Reference numeral 9 denotes a hole located at the bottom end of the inverse truncated cone portion 4. The hole 9 allows the needle 13 to move vertically therethrough. A hole 11 is formed in the support member 8. The mounting screw 20 is installed through the hole 11 so as to removably attach the protecting apparatus 1 to the presser bar 12. Components of a sewing machine are denoted as follows: reference numeral 15 denotes a thread engagement portion of the needle; reference numeral 16 denotes a presser member; reference numeral 17 denotes a presser member mounting bracket; reference numeral 18 denotes a throat plate; reference numeral 19 denotes a face plate; and reference numeral 21 denotes a table.

Since the tip portion of the needle 13 is covered with the needle cover 2, the following advantages are provided. The needle 13 is prevented from preventing by accident through a fingertip of a worker. When the needle 13 is broken, its broken pieces are prevented from scattering around. Thus, there can be prevented an accident that a broken piece of the needle 13 enters an eye or mouth of a worker.

Most broken pieces of the needle 13 adhere to the non-drying adhesive layer 7 formed on the inner wall surface 6 of the needle cover 2. Those broken pieces which have failed to adhere to the adhesive layer 7 drop below the needle cover 2. Accordingly, although some broken pieces may come out through the cut portion 5, broken pieces of the needle 13 can be readily collected, thereby reducing loss time required for collecting the broken pieces.

A single-needle lock stitch process will now be taken as an example. When a work is handled at a position close to a presser, an index or middle finger of a worker's left hand may be positioned underneath a needle which is located at an upper position of its vertical stroke. This may lead to an accident that the needle penetrates the fingertip. The protecting apparatus 1 according to the present invention covers the needle 13 substantially completely. Therefore, there exists no clearance which allows a fingertip of a worker to enter a passage of the vertically moving needle 13 during sewing work. Thus, a worker is protected from an accident that a needle penetrates his/her fingertip, while conventional sewing performance is maintained. Further, even in a sophisticated sewing process, the features of the apparatus are not deteriorated.

The second embodiment of the protecting apparatus according to the present invention will now be described with reference to FIGS. 4 to 9. A needle 13 moves vertically within the needle cover 2 made of a transparent synthetic resin. A plastic magnet member 23 having an inverse truncated cone shape is fixedly attached using adhesive or the like to the bottom section of an inverse truncated cone portion 4, which extends downward from the bottom section of a cylindrical portion 3 of the needle cover 2. The plastic magnet member 23 is used to capture broken pieces of the needle 13. The needle cover 2 is held by a bracket 53, which, in turn, is removably attached to the presser bar 12 by forked elastic holding portions 25 and 25. The bracket 53 is pivotably attached to a pin 36 of a stationary section 24 of the cylindrical portion 3. The holding portions 25 and 25 of the bracket 53 are attached to the presser bar 12 using a clamp screw 59, thereby attaching the bracket 53 to the presser bar 12.

Figure 8:
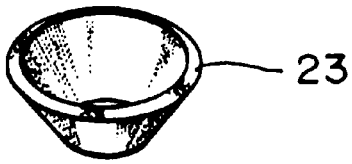
FIG. 8 is a perspective view of a plastic magnet member having an inverse truncated cone shape which is used in the second embodiment of the protecting apparatus.

The cylindrical portion 3 of the needle cover 2 is divided in its longitudinal direction into an openable section 22 and the stationary section 24. The openable section 22 can pivot about the pin 36 of a pivot section 27. The openable section 22 and the stationary section 24 engage together at an engagement section 26. The openable section 22 can be opened/closed with respect to the stationary section 24. A plastic magnet member 23 having an inverse truncated cone shape as shown in FIG. 8 is attached to the bottom section of the inverse truncated cone portion 4, which is part of the stationary section 24. Reference numeral 28 denotes a knob used to open/close the openable section 22.

Figure 4:
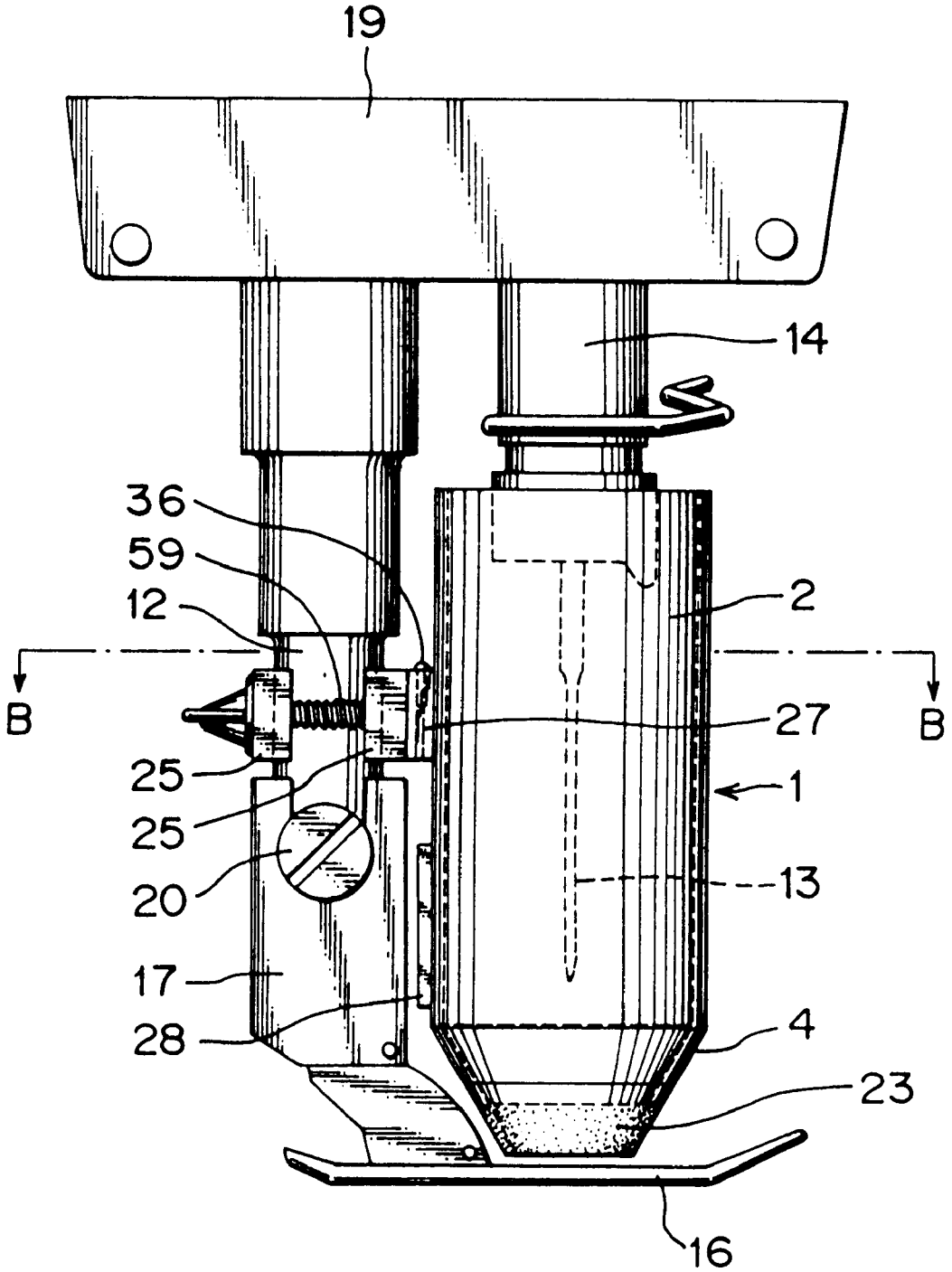
FIG. 4 is a side view of a second embodiment of the protecting apparatus.
Figure 5:
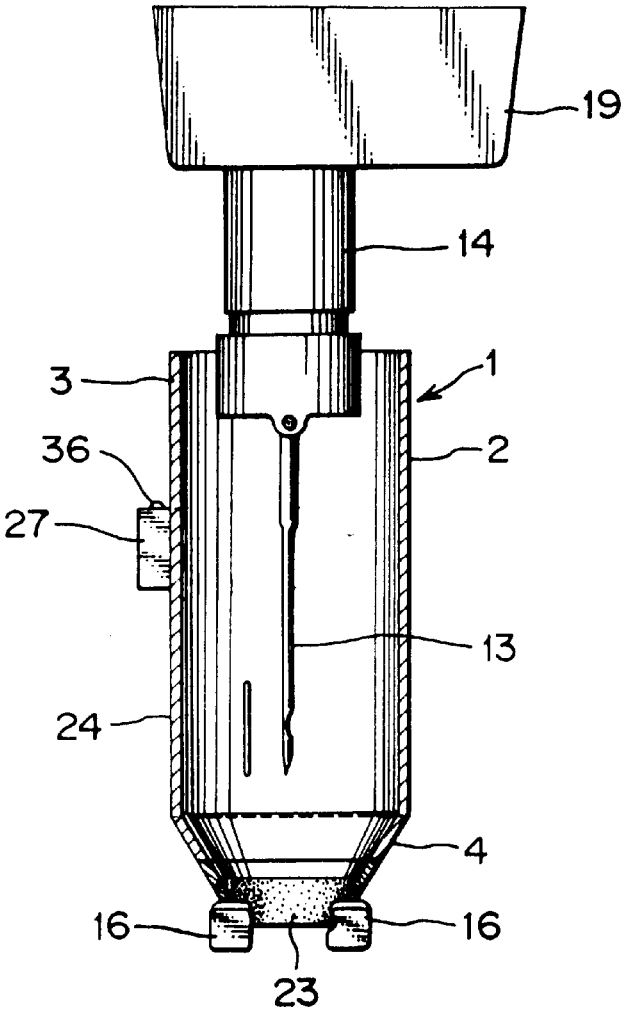
FIG. 5 is a longitudinal section of the second embodiment of the protecting apparatus.
Figure 6:
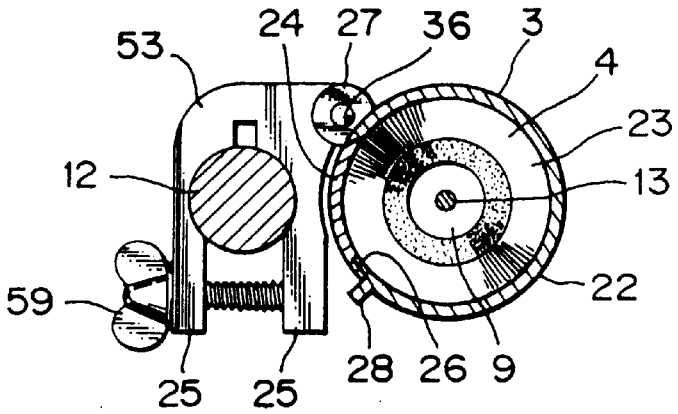
FIG. 6 is a cross-section taken along line 6—6 of FIG. 4.
Figure 7:
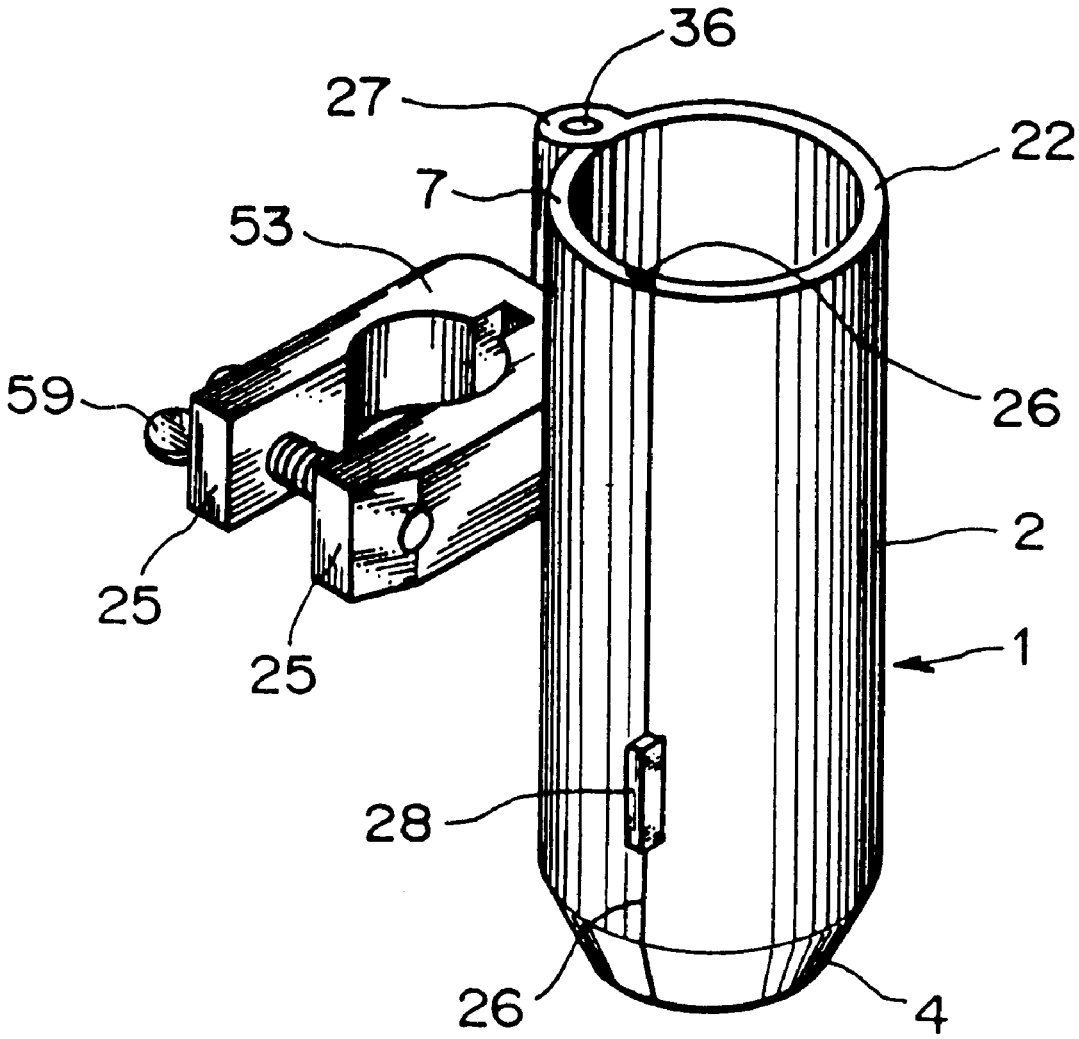
FIG. 7 is a perspective view showing a main portion of the second embodiment of the protecting apparatus.

FIG. 7 shows the cylindrical portion 3 in which the pin 36 is attached to the pivot section 27 in a manner different from that shown in FIGS. 4 to 6. The pivot section 27 extends up to the top end of the cylindrical portion 3. Accordingly, the pin 36 is mounted at the top end section of the cylindrical portion 3.

Figure 9:
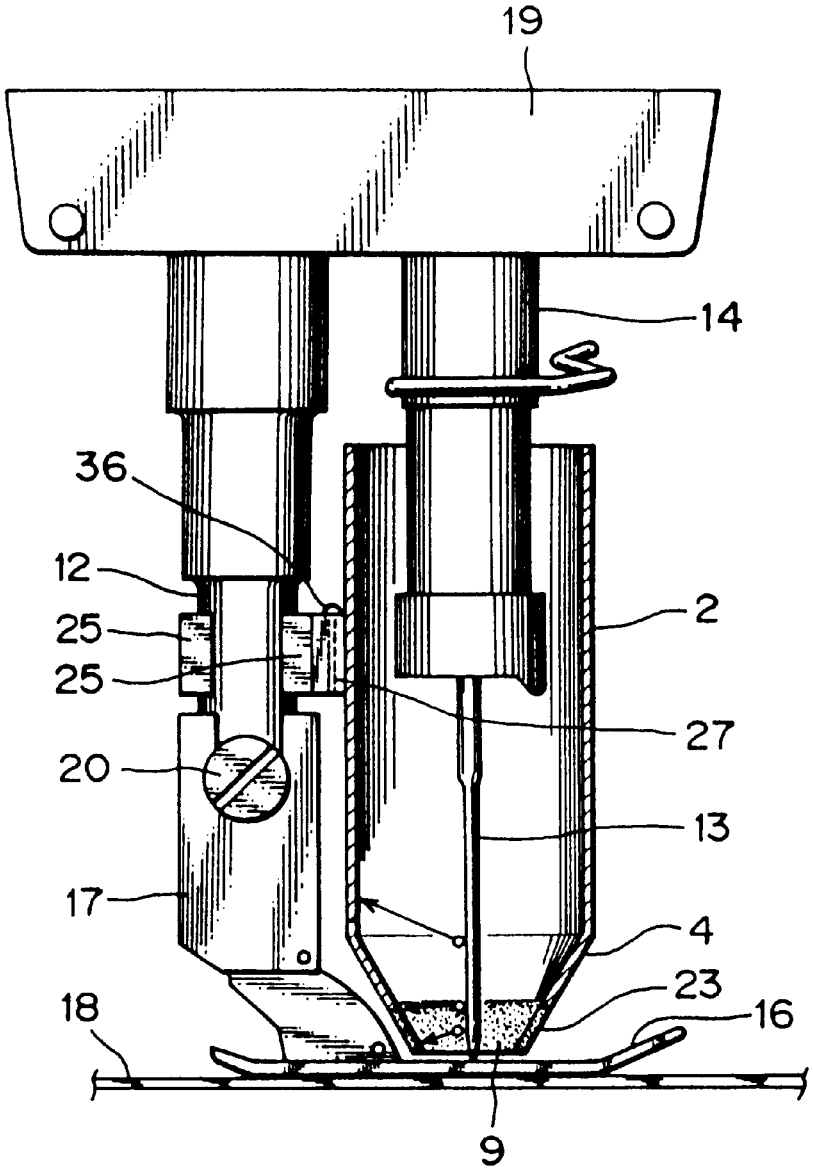
FIG. 9 is a partially cross-sectioned side view of the second embodiment of the protecting apparatus, illustrating the state that a needle breaks.

As shown in FIG. 9, when the needle 13 breaks within the cylindrical portion 3, broken pieces scatter as shown by an arrow. The scattering broken pieces hit the inner wall of the cylindrical portion 3 or the inner wall of the plastic magnet member 23 and then drops along the inner wall. While the broken pieces drop along the inner wall, they are attracted onto the inner surface of the plastic magnet member 23. Thus, the broken pieces do not scatter outside the needle cover 2.

The third embodiment of the protecting apparatus according to the present invention will now be described with reference to FIGS. 10 and 11. A conical turnup portion 30 is formed at the lower end of the inverse truncated cone portion 4, which extends downward from the bottom section of the cylindrical portion 3 of the needle cover 2. Thus, a groove portion 31 is formed between the turnup portion 30 and the inner wall of the inverse truncated cone portion 4. A plastic magnet member 29 having a truncated cone shape is fixedly attached using adhesive or the like to the outer circumferential surface of the conical turnup portion 30. When the needle 13 breaks within the cylindrical portion 3, broken pieces scatter and hit the inner wall of the cylindrical portion 3 or of the inverse truncated cone portion 4 and then drop along the inner wall. While the broken pieces drop along the inner wall, they are captured in the groove portion 31 by a magnetic force of the plastic magnet member 29.

The fourth embodiment of the protecting apparatus according to the present invention will now be described with reference to FIGS. 12 to 15. A needle cover 32 is made of a transparent synthetic resin and formed by bending into a non-cylindrical shape such that it surrounds the presser bar 12 and the needle bar 14. The non-cylindrical needle cover 32 is removably attached to the presser bar 12 using a mounting screw 20. The lower portion of the needle cover 32 forms a skirt portion 60 which surrounds the presser bar 12 and the needle 13 so as to prevent broken pieces of the needle 13 from scattering. The needle cover 32 is formed by bending along four bending portions 44, so as to form the following covering portions: a covering portion 37 for covering the presser bar 12 from behind the presser bar 12; a covering portion 38 for covering the presser bar 12 from obliquely behind the presser bar 12; a covering portion 39 for covering the presser bar 12 and the needle bar 14 from one side; a covering portion 40 for covering the needle bar 14 from the front of the needle bar 14; and a covering portion 41 for covering the presser bar 12 and the needle bar 14 from the other side.

The non-cylindrical needle cover 32 is removably attached to the presser bar 12 by a locking screw 34. The locking screw 34 is inserted into the needle cover 32 through a cut portion 42 as well as through a hold 43. Reference numeral 35 denotes a cushion member used in combination with the locking screw 34.

The fifth embodiment of the protecting apparatus according to the present invention will now be described with reference to FIGS. 16 to 19. Presser members 33 and 33 made of plastic magnet are attached to a presser member mounting bracket 17 by tightening a machine screw 46 through a screw hold 50 that is formed in a mounting portion 49. A magnet portion 48 is formed at the bottom of each of the presser members 33 and 33. The presser member mounting bracket 17 is mounted to the presser bar 12 using a mounting screw 20, which is tightened through a cut portion 47 formed in the presser member mounting bracket 17. Reference numeral 45 denotes a spring member.

The sixth embodiment of the protecting apparatus according to the present invention will now be described with reference to FIGS. 20 and 21. A non-cylindrical needle cover 32 has a curved portion 61 for covering the needle 13, and an upper rib 62 which is provided at the top end of the curved portion 61. A thin-walled skirt portion 60 made of a transparent synthetic resin forms the lower portion of the needle cover 32 and surrounds the presser bar 12 and the needle 13 so as to prevent broken pieces of the needle 13 from scattering. The needle cover 32 is U-shaped and further includes thick-walled portions 63 and 63. The thick-walled portions 63 and 63 extend from the upper rib 61 so as to cover the presser bar 12 from both sides. Engagement portions 56 and 56 of the thick-walled portions 63 and 62 are engaged with side portions 57 and 57 of anchoring member 54 which is made of iron and which have a shape of lying squarish letter U. Bottom end portions 58 and 58 of the side portions 57 and 57 are engaged with a mounting screw 20, thereby easily and reliably mounting the needle cover 32 to the presser bar 12. A coin-shaped magnet 55 is attached to the closed-end portion of the anchoring member 54. Magnetic presser members 51 and 51 are attached to the magnetic mounting bracket 52, which, together with the anchoring member 54, is mounted to the presser bar 12 using the mounting screw 20.

The apparatus for protection from a broken needle includes the non-cylindrical needle cover 32 which allows the needle 13 to move vertically therein and which is formed so as to cover the needle bar 14 as well as to extend to the vicinity of the presser member 51. Since the coin-shaped magnet 55, which generates a large magnetic force, is located adjacent to the presser bar 12, the presser bar 12 and the presser member 51, both of which are made of a magnetizable metal member, can be magnetized by the coin-shaped magnet 55.

What is claimed is:

1. An apparatus for protection from a broken needle of a sewing machine, comprising:

a needle cover made of a transparent synthetic resin and having a cylindrical portion within which a needle of the sewing machine moves vertically; and a magnet portion having an inverse truncated cone shape and provided at the lower end of the cylindrical portion of the needle cover;

wherein said needle cover is removably attached to a presser bar of the sewing machine.

2. An apparatus for protection from a broken needle of a sewing machine according to claim 1, wherein said cylindrical portion of said needle cover is formed so that said cylindrical portion can be opened along its longitudinal direction.

3. An apparatus for protection from a broken needle of a sewing machine according to claim 1, wherein said magnet portion is provided on the outer wall surface of the bottom end section of said inverse truncated cone portion.

4. An apparatus for protection from a broken needle of a sewing machine, comprising:

a needle cover made of a transparent synthetic resin within which a needle of the sewing machine moves vertically, said needle cover being formed such that said needle cover surrounds a needle bar and a presser bar of the sewing machine, and such that the bottom end of said needle cover includes a magnet to pick up pieces of broken needles and is removably attached to the presser bar of the sewing machine.

5. An apparatus for protection from a broken needle of a sewing machine, comprising:

a needle cover made of a transparent synthetic resin within which a needle of the sewing moves vertically, said needle cover is formed such that said needle cover surrounds bar and a presser bar of the sewing machine, and such that the bottom end of said needle cover is located in the vicinity of a magnetized presser member, wherein said needle cover is removably attached to the presser bar of the sewing machine.

6. An apparatus for protection from a broken needle of a sewing machine according to claim 4 or 5, wherein a needle capturing portion made of a magnet is provided at the upper portion of the presser member.

7. An apparatus for protection from a broken needle of a sewing machine, comprising:

a needle cover made of a transparent synthetic resin within which a needle of the sewing moves vertically, said needle cover is formed such that said needle cover surrounds bar and a presser bar of the sewing machine, and such that the bottom end of said needle cover is located in the vicinity of a presser member; and a magnet member provided adjacent to the presser bar to which a support member of said needle cover is attached, wherein the presser bar and the presser member are made of a metallic member so as to be magnetized by said magnet member.

* * * * *